United States Patent [19]

Ross

[11] 4,008,881

[45] Feb. 22, 1977

[54] PORTABLE WINCH RATCHET DOG

[75] Inventor: Karl J. Ross, Maumee, Ohio

[73] Assignee: American Gage & Manufacturing Co., Wauseon, Ohio

[22] Filed: Mar. 17, 1975

[21] Appl. No.: 558,644

[52] U.S. Cl. ..... 254/164; 254/DIG. 12

[51] Int. Cl.[2] ..... A63B 61/04

[58] Field of Search ..... 254/161, 164, 163, 167, 254/186 HC, DIG. 12; 74/149, 154

[56] References Cited

UNITED STATES PATENTS

| | | | |
|---|---|---|---|
| 3,163,400 | 12/1964 | Skerry | 254/167 |
| 3,248,087 | 4/1966 | Hallen | 254/167 |
| 3,765,652 | 10/1973 | Janik | 254/167 |
| 3,838,845 | 10/1974 | Minter et al. | 254/164 |

*Primary Examiner*—Robert J. Spar
*Assistant Examiner*—Kenneth Noland
*Attorney, Agent, or Firm*—Beaman & Beaman

[57] ABSTRACT

A portable winch unit of the ratchet type utilizing a ratchet dog mounted upon a hand lever for rotating the winch drum ratchet wheel wherein the ratchet dog is pivotally mounted upon the hand lever for pivoting between ratchet wheel. engaging and ratchet wheel clearing positions. The dog includes an elongated slot receiving the end of a tension spring and a pivoted spring shifter plate mounted adjacent the dog shifts the spring end within the dog slot between two operative positions. The other end of the spring is anchored to the hand lever, and the orientation between the anchored spring end, the spring end within the ratchet dog slot, and the dog pivot axis is such that pivoting of the spring end within the slot by the spring shifter between the operative positions thereof produces a biasing force on the dog pivoting the same between ratchet wheel engaging and clearing positions.

4 Claims, 6 Drawing Figures

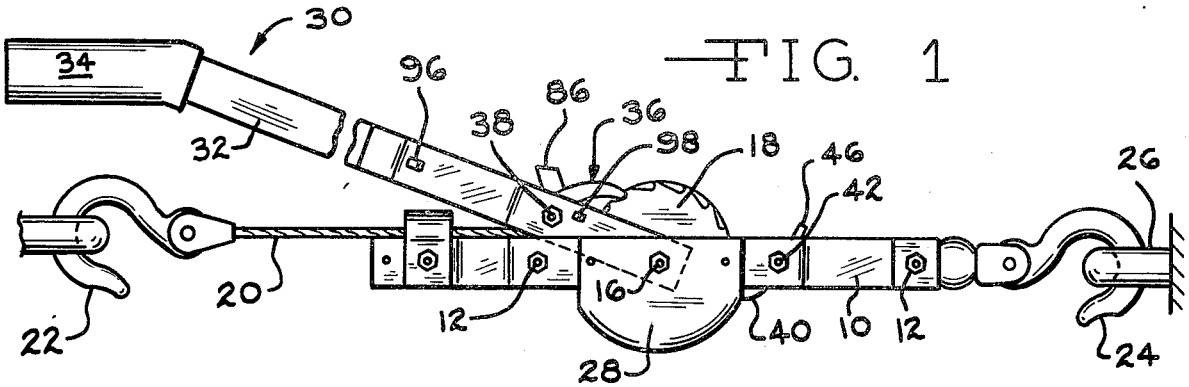
FIG. 1
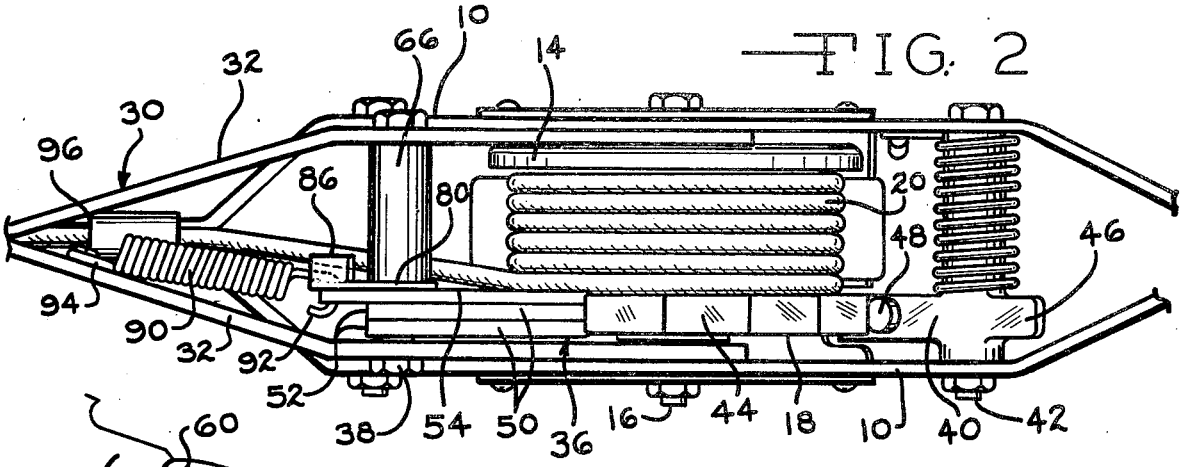
FIG. 2
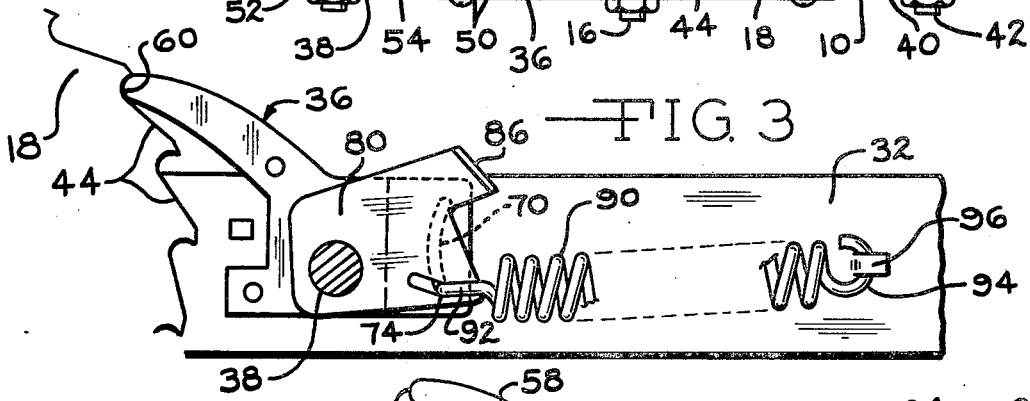
FIG. 3
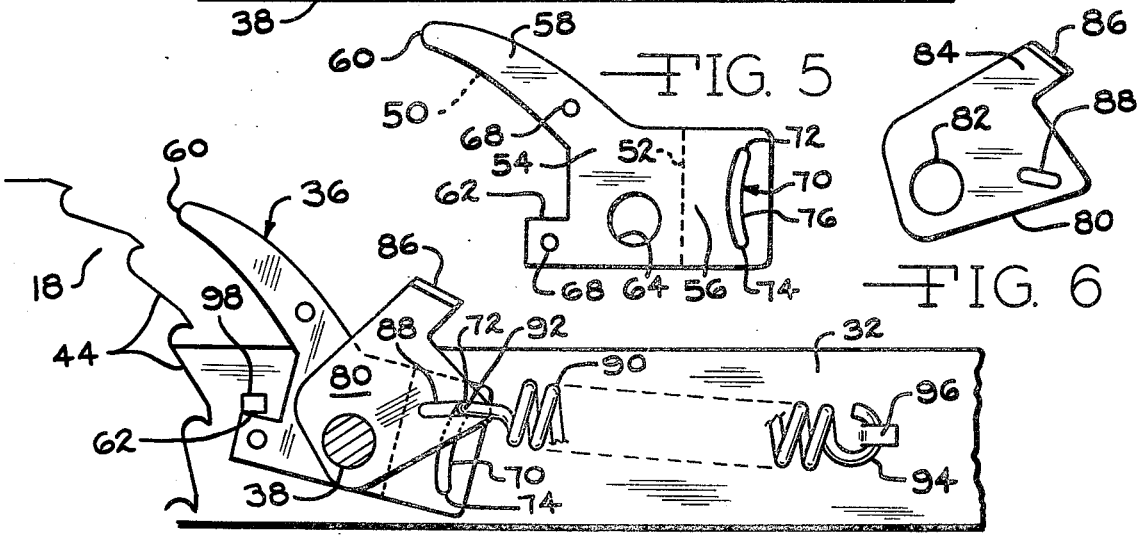
FIG. 5
FIG. 6
FIG. 4

PORTABLE WINCH RATCHET DOG

BACKGROUND OF THE INVENTION

The invention pertains to portable winch units of the ratchet drum type, and in particular, relates to the ratchet dog employed to transmit force from a hand lever to the winch drum.

In portable winch units such as shown in U.S. Pat. No. 2,501,253, and in the assignee's more recently issued U.S. Pat. Nos. 3,724,816 and 3,727,886, portable winch units are shown which utilize a hand lever to rotate a drum upon which a tension member, such as a cable, is wound. The drum includes a ratchet wheel configuration engagable with a dog or catch mounted upon the hand lever wherein a rotative driving force can be imparted to the drum upon pivoting of the hand lever in a cable tensioning direction. A stop pawl is mounted upon the apparatus frame also engaging the ratchet wheel to prevent rotation of the drum against the tensioning force, and the hand lever ratchet dog, and the stop pawl, are spring biased in a direction toward the ratchet wheel, and may be selectively removed from the ratchet wheel to permit rapid deployment of the cable from the drum.

In that the hand lever mounted ratchet wheel dog is selectively positioned between ratchet wheel engaging and clearing positions, and must be positively maintained in such positions, a variety of operating mechanisms have been proposed for positioning the ratchet dog. Such ratchet dogs must be of high strength, dependable in operation, easily operable, and readily manufacturable. The ratchet dog operating mechanisms of the assignee's above identified patents are improvements over existing ratchet dog operating mechanism, but do not meet all of the requisites of such a ratchet dog to the extent desired.

A simple, yet dependable ratchet pawl of economical construction is shown in use with a wrench in U.S. Pat. No. 635,207, and in such ratchet pawl operation the end of a tension spring is slidably positionable with respect to the pivot point of the ratchet dog to selectively permit the spring to impose a biasing force on the ratchet dog causing the dog to be pivoted in opposite directions. Such an arrangement requires that the spring itself be directly engaged by the operator in order to shift the spring end with respect to the dog, and as the most likely location of engagement of the spring occurs at the coils thereof, the likelihood of pinching exists when shifting the coil spring on the dog. Thus, although this type of ratchet dog biasing mechanism meets several of the desired requisites of pivoted ratchet dogs, the direct engagement of the spring by the operator's finger is objectionable, and a safety hazard.

SUMMARY OF THE INVENTION

It is an object of the invention to provide a portable winch having a ratchet dog mounted upon a hand lever wherein a tension spring biasing the ratchet dog in a desired direction may be manually shifted between selected positions within an elongated slot defined upon the ratchet dog without direct engagement of the spring by the operator eliminating any possibility of harm to the operator.

In the practice of the invention the hand lever mounted ratchet dog is pivotally mounted for rotation between ratchet wheel engaging and clearing positions. The ratchet dog pivots upon the hand lever and includes a nose adapted to selectively engage the ratchet wheel, and a rear portion is defined on the dog upon the opposite side of the dog with respect to the nose. An elongated arcuate slot is defined in the dog rear portion, and the slot is defined by ends located closer to a spring anchor defined upon the hand lever than is the central region of the slot. A tension spring has one end received within the slot shiftable between the slot ends, and the other spring end is anchored to the hand lever. A spring shifter pivotally mounted upon the dog pivot includes an opening through which the spring end received within the dog slot extends, and a handle formed upon the shifter permits pivoting of the shifter about the dog pivot axis. Pivotal movement of the shifter causes a shifting of the spring end within the slot between the slot ends, thereby determining the direction of application of spring biasing force on the dog with respect to its pivot axis, causing the dog's nose to be biased toward a ratchet wheel engaging position, or to be biased away from a ratchet wheel in order to clear the same.

The spring shifter opening is in the form of a slot having a length transversely disposed to the general length of the dog slot whereby the shifter will not create a binding of the associated spring end within the dog slot or opening during shifting. The presence of the handle on the spring shifter permits ready manual positioning of the shifter without requiring manual contact with the tension spring, and the likelihood of harm coming to the operator during operation is significantly reduced.

BRIEF DESCRIPTION OF THE DRAWINGS

The aforementioned objects and advantages of the invention will be appreciated from the following description and accompanying drawings wherein:

FIG. 1 is a side elevational view of a portable winch in accord with the invention illustrating the ratchet dog in ratchet engaging position, FIG. 2 is a detail, enlarged, top plan view of the portable winch cable drum and associated mechanism as taken from the top of FIG. 1, FIG. 3 is a detail, sectional view of the drum ratchet engaging dog components in the position for the dog engaging the ratchet wheel, FIG. 4 is a view similar to FIG. 3 illustrating the dog components in the position for the dog clearing the ratchet wheel, FIG. 5 is a side, elevational view of the ratchet dog, per se, and FIG. 6 is an elevational view of the dog spring shifter, per se.

DESCRIPTION OF THE PREFERRED EMBODIMENT

The portable winch structure shown in FIGS. 1 and 2 of the drawings is identical, except with respect to the ratchet wheel dog mechanism, to the apparatus disclosed in assignee's U.S. Pat. No. 3,727,886. This apparatus includes a frame formed of spaced strap elements 10 interconnected by spacer bolts 12. Intermediate the spaced straps is rotatably mounted a drum 14 upon axle bolt 16. The drum 14 includes a concentric ratchet wheel 18 formed as an integral part of the drum, or rigidly affixed thereto, and the tension member, such as a flexible cable 20, is adapted to be wound upon the drum having a hook 22 located at the outer end. An anchor hook 24 is affixed to the frame straps 10, at the right, FIG. 1, for attachment of the frame to a fixed anchor 26. The underside of the drum 14 is encased in a sheet metal shield 28.

Rotation of the drum 14 is provided through the hand lever 30 pivotally mounted upon the frame 10 by means of the axle bolt 16. The hand lever 30 consists of a pair of metal straps 32 sufficiently spaced apart adjacent the axle bolt 16 to straddle the drum 14, and these straps converge to unite at the handle 34. The ratchet wheel dog, generally indicated at 36, is pivotally mounted upon a pivot bolt 38 extending between the straps of the hand lever 30, and the particular configuration and structure of the ratchet wheel dog is described later.

Rotation of the drum 14 in a cable unwinding direction is prevented by the stop pawl 40 mounted upon a pivot bolt 42 interposed between frame straps 10. The stop pawl engages the teeth 44 of the ratchet wheel to permit only clockwise rotation of the drum as viewed in FIG. 1, and the stop pawl includes a handle portion 46 which may be manually operated to pivot the stop pawl clear of the drum ratchet wheel to permit unreeling of the cable from the drum. The stop pawl also includes an abutment 48 which is adapted to be engaged by the ratchet wheel dog 36 during full clockwise rotation of the hand lever 30, FIG. 1, to release the stop pawl and produce a tooth-by-tooth indexing of the drum 14 in the unreeling direction one ratchet tooth at a time in the manner as described in U.S. Pat. No. 3,727,886.

The improvement of the instant invention lies in the particular construction of the ratchet wheel dog 36 and its operating mechanism. As described, the dog 36 is pivotally mounted upon the hand lever 30 upon pivot bolt 38, and as will be appreciated from FIG. 2, the dog is in radial alignment with the drum ratchet wheel 18 and maintained in this orientation by spacer sleeve 66. The dog is preferably formed of three laminations of sheet metal spot welded together, or otherwise mechanically interconnected, such as to have a width in the axial direction of the pivot 38 substantially equal to the axial width of the ratchet wheel.

The configuration of the ratchet dog is best appreciated from FIGS. 3 and 5. The two laminations 50 are identical in configuration, and are of a partial shape as shown in FIG. 5, however, terminate at a rear edge 52 indicated by the dotted line in FIG. 5. The third lamination 54 of the dog is of the configuration of FIG. 5 which includes a rear portion 56 extending beyond the rear edge 52 of the other two laminations. The dog also includes an elongated ratchet wheel engaging portion 58 terminating in nose 60. A stop shoulder 62 is defined upon the dog, and the hole 64 is slightly larger than the pivot bolt 38 such that the dog may readily pivot upon the pivot bolt. The mechanical interconnection between the laminations of the dog include the indentations 68.

The rear portion 56 of the dog lamination 54 includes a spring anchor slot 70 defined therein which extends through the lamination and is of an arcuate configuration defined by ends 72 and 74. The central region of the slot is indicated at 76, and bows in the direction of the pivot hole 64.

The spring shifter 80, FIG. 6, is formed as a plate, and includes a hole 82 for receiving the dog pivot bolt 38 whereby the shifter may readily pivot upon the bolt adjacent the outer surface of the dog lamination 54, FIG. 2. The shifter includes an extension 84 having an end bent at right angles thereto to form a handle 86. An elongated opening 88 is also defined in the shifter plate, and is at such a distance from the hole 82 such that the opening 88 will align with the slot 70 when the shifter 80 and the dog 36 are mounted upon the pivot bolt 38, as shown in FIGS. 3 and 4. The shifter 80 is located upon the pivot bolt 38 with the handle 86 extending away from the dog 36.

Coil tension spring 90 includes a hooked end 92 which extends through the shifter plate opening 88, and into the dog slot 70 and an anchored end 94 which is connected to the adjacent hand lever strap 32 by a lanced tab 96, constituting a spring anchor. The length of the spring 90 is such that the spring is under moderate tension at all times.

When it is desired that the dog 36 engage the teeth 44 of the ratchet wheel 18 the handle 86 of the shifter 80 is depressed to rotate the shifter in a clockwise direction on bolt 38, FIG. 3. This action will force the spring end 92 downwardly against the dog slot end 74 due to the fact that the spring end 92 extends through the shifter opening 88, as well as through the dog slot 70. Location of the spring end 92 adjacent the slot end 70 locates the connection of the spring end upon the dog slightly "below" the axis of pivot bolt 38, with respect to the alignment with the spring anchor tab 96 causing the spring to impose a biasing action on the dog 36 in the counterclockwise direction, FIG. 3. This biasing action will engage the nose 60 with the ratchet teeth 44 permitting the hand lever 30 to impart a winding rotation to the drum 14 upon clockwise rotation of the hand lever as viewed in FIG. 1. As the hand lever is returned to initiate another winding "pull" the nose 60 will ride over the ratchet teeth 44, and yet remain in engagement therewith due to the biasing force of spring 90.

When it is desired to permit the drum 14 to freely rotate, as when significant lengths of cable are to be unreeled therefrom, the dog 36, as well as the stop pawl 40, must be removed from the drum ratchet wheel. The dog 36 is "cleared" from the ratchet wheel 18 by the operator grasping the shifter handle 86 and rotating the shifter in a counterclockwise direction, FIG. 4, such that the spring end 92 is raised in the dog spring slot 70 to engage the upper end 72 of the slot as shown in FIG. 4. The locating of the spring end 92 at slot end 72 now causes the direction of biasing force of the spring, as defined by the spring anchor tab 96 and the spring end 92, to be "above" the pivot bolt 38 biasing the dog 36 in a clockwise direction, FIG. 4. The rotation of the dog in the clockwise direction is limited by the engagement of the dog stop shoulder 62 with the stop 98 lanced from the hand lever strap 32. At this position the nose 60 of the dog is held away from the ratchet wheel teeth 44, and upon release of the stop pawl 40 the cable 20 may be rapidly unreeled from the drum 14.

When tensioning of the cable 20 is desired, the operator merely engages shifter handle 86 with his finger to depress the same and shift the spring end 92 to the slot end 74 as shown in FIG. 3, and rotation of the hand lever 30 will again impart rotation to the drum. It will be appreciated that as the length of the shifter opening 88 is transversely disposed to the general length of the dog slot 70 the arcuate configuration of the slot 70 will not cause a binding during operation of the shifter since, at all times, an alignment exists between the slot 70 and the opening 88 capable of receiving the spring end 92. Further, it is to be appreciated that due to the arcuate configuration of the slot 70 wherein the central region 76 thereof is at a greater distance from spring anchor tab 96, than the ends 72 and 74 that once the spring end 92 is located adjacent a slot end there is no tendency for the spring end to shift of its own accord within the slot 70, and thus the adjustment of the spring end 92 within the slot 70, once made, will be maintained until changed by the operator.

The use of the shifter 80 avoids any requirement for the operator to engage the spring 90 directly, and thereby eliminates the possibility of pinching.

It is appreciated that various modifications to the inventive concept may be apparent to those skilled in the art without departing from the spirit of the invention.

I claim:

1. In a portable winch having a drum and ratchet wheel mounted upon a frame for rotation about an axis, a hand lever pivoted upon said frame for rotation about said axis, tension transmitting means wound upon said drum, a releasable stop pawl pivotally mounted upon said frame engaging said ratchet wheel permitting unidirectional rotation of said drum, the improvement comprising a ratchet dog, a pivot pivotally mounting said ratchet dog upon said hand lever for pivoting between an operative position engageable with said ratchet wheel and an inoperative position clearing said ratchet wheel during pivoting of said hand lever about said axis, an elongated closed spring anchor slot defined on said dog having spaced first and second spring receiving portions, a spring anchor defined on said hand lever, said slot being located between said pivot and said spring anchor, a tension spring having a first end directly slidably received within said slot and a second end attached to said anchor, and a spring shifter comprising a member pivotally mounted on said pivot directly engaging said spring first end adjacent said slot selectively shifting said spring first end within said slot between said first and second spring receiving portions, an opening defined in said spring shifter member receiving said spring first end, said anchor, spring receiving portions and pivot being so related that positioning said first spring end at said first spring receiving portion misaligns said spring first end from a straight line relationship between said pivot and spring anchor to produce a biasing force which pivots and maintains said dog at said operative position and positioning said first spring end at said second spring receiving portion misaligns said spring first end from a straight line relationship between said pivot and spring anchor to produce a biasing force which pivots and maintains said dog at said inoperative position.

2. In a portable winch as in claim 1 wherein said member comprises a plate engaging said dog.

3. In a portable winch as in claim 1 wherein said dog includes a ratchet wheel engaging nose and a rear portion, said pivot being located between said nose and said rear portion, said spring anchor slot being defined in said dog rear portion.

4. In a portable winch as in claim 3 wherein said spring anchor slot is of an arcuate configuration and including first and second ends and a central region, said central region being spaced further from said spring anchor than said slot ends, said slot ends constituting said first and second spring receiving portions, respectively.

* * * * *